United States Patent [19]

Winter et al.

[11] 4,325,537

[45] Apr. 20, 1982

[54] SNATCH BLOCK

[75] Inventors: Robert A. Winter; David J. Steger, both of Mentor, Ohio

[73] Assignee: Merriman Holbrook, Inc., Grand River, Ohio

[21] Appl. No.: 92,576

[22] Filed: Nov. 8, 1979

[51] Int. Cl.[3] ..... B66D 1/36

[52] U.S. Cl. ..... 254/405; 254/413; 114/204

[58] Field of Search ..... 114/204, 218, 112; 254/402, 405, 406, 411, 412, 413, 409, 401

[56] References Cited

U.S. PATENT DOCUMENTS

| | | | |
|---|---|---|---|
| 733,239 | 7/1903 | Maddox | 254/405 |
| 2,202,184 | 5/1940 | Berger | 254/409 |
| 2,288,116 | 6/1942 | Stillwagon | 254/405 |
| 2,555,059 | 5/1951 | Schrader | 254/406 |
| 2,723,834 | 11/1955 | Burke et al. | 254/402 |
| 2,772,857 | 12/1956 | Bush | 254/413 |
| 3,199,841 | 8/1965 | McKean | 254/405 |
| 3,372,908 | 3/1968 | McCarthy | 254/405 |
| 3,678,876 | 7/1972 | Alter | 114/204 |

*Primary Examiner*—Robert J. Spar
*Assistant Examiner*—Kenneth Noland
*Attorney, Agent, or Firm*—Richard H. Thomas

[57] ABSTRACT

A novel snatch block particularly suitable for marine use and for movement on a boat deck mounted track, comprising a track slide portion and an upper sheave assembly. The sheave assembly comprises a pair of normally spaced-apart side cheeks; a sheave pin extending between said cheeks; and a sheave rotatably mounted on said sheave pin. Structure is provided for holding the sheave pin at one end to one of the side cheeks, and releasably engaging the sheave pin at the opposite end with the other of the side cheeks to hold the sheave assembly in a normally closed position. Both the side cheeks are pivotally mounted on the slide portion so that with release of one of the side cheeks by the sheave pin, the sheave assembly is capable of expanding to a wider opening than available with conventional snatch blocks.

6 Claims, 5 Drawing Figures

SNATCH BLOCK

The present invention relates to a novel snatch block, especially to one suitable for marine use and movable on a deck mounted track.

BACKGROUND OF THE PRESENT INVENTION

It is well known to provide track movable blocks for marine use. In such case, the track may be mounted on a boat deck. The movable block is provided with a slide portion which engages the track edges, the block being pivotally attached to the slide portion. In the case of a lead block, it is often desirable to orient the track for fore and aft movement of the block, the latter pivoting crosswise or sideways with respect to the track orientation. In operation, a sheet is fed into the block around the block sheave, and pivotability of the block readily permits it to adapt to the bias of the sheet.

However, it frequently is necessary to quickly transfer a sheet from one block to another, for instance in racing, or introduce a different sheet into the block, and depending upon the length of the sheet, an inordinate amount of time may be required to unthread a sheet from a block and then go through the step of rethreading it or a different sheet. In racing in particular, a need exists for a track mounted snatch block which eliminates the unthreading and rethreading steps required of conventional blocks. At the same time, the block must be simple in construction, capable of resisting corrosion for instance by exposure to salt water, and must have a high strength-to-weight ratio for obvious reasons.

Snatch blocks are well known and have been developed for a variety of purposes. An example of one such block is shown in prior U.S. Pat. No. 2,555,059 to Schrader. In this patent, there is illustrated a swingably mounted block side which swivels on the same journal pin on which the block sheave or pulley is mounted, the side swinging or pivoting in a plane perpendicular to the pin or parallel to the line of force normally applied to the block. The side has an inwardly extending hook shaped extension which engages a recess in the block when the side is swung to a closed position. To move the side from a closed to open position, the side has on its exposed face an enlargement called in the patent a finger rest suitable for hand pressure. It is anticipated that the design of this patent would be subject to fatigue cracks under high loads by virtue of the manner of engagement between the swingable side and the body of the block. In addition, a block of this type suffers in the limited amount of access to the sheave provided by the swingable side. Such a block would be totally unsuitable for marine use. Particularly at night, it would be a difficult matter to rapidly load such a block during a lead change.

Prior U.S. Pat. No. 3,199,841 to McKean is illustrative of a different type of snatch block. This patent discloses a block housing in which the sheave cover pivots between an open and closed position exposing the sheave groove. One problem with the design of this patent is that it is not readily adaptable to track mounting. The cover itself would have to be integral with or fastened to the track slide, and then the entire block assembly including the sheave and sides would have to pivot relative to the sheave cover. Since both sides would be conveyed with the sheave, in the pivoting movement, it would be necessary, in threading or unthreading a sheet from the block, to pull the sheet around the free edge of the side which is pivoted away from the sheave cover. This can be awkward, particularly at night, rendering the design of the McKean patent unsuitable for marine use.

SUMMARY OF THE PRESENT INVENTION

The present invention provides a dramatic departure from the snatch blocks of known design, in the provision of a track slide portion; an upper sheave assembly affixed to said slide portion; the sheave assembly comprising a pair of normally spaced-apart side cheeks; a sheave pin extending between said cheeks when the sheave is in a normally closed position; and a sheave rotatably mounted on said sheave pin. Means are provided holding said sheave pin at one end to one of said side cheeks, and releasably engaging said sheave pin at the opposite end with the other of said side cheeks to hold said sheave assembly in a normally closed position. Both said side cheeks are pivotally mounted on said slide portion so that with release of one of said side cheeks by the sheave pin, the sheave assembly is capable of expanding or moving to a wide open position.

The present invention will be more particularly described with reference to the accompanying drawings, in which.

Figure 1:
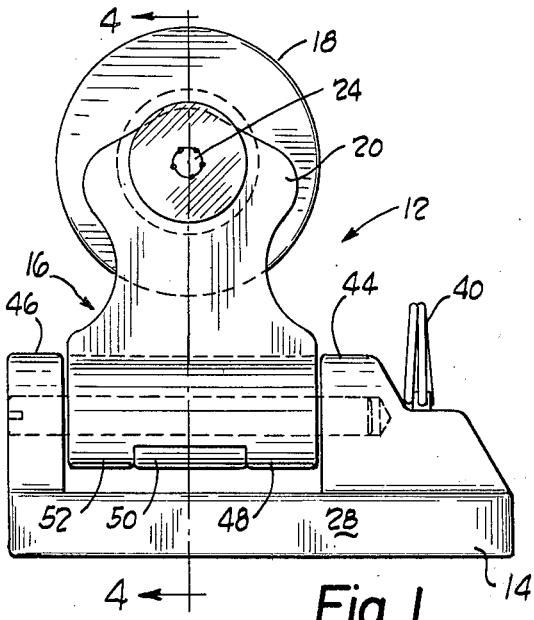
FIG. 1 is an elevation side view of one side of a snatch block in accordance with the concepts of the present invention.

Referring to the drawings, and in particular FIG. 1, there is illustrated a snatch block 12, in accordance with the concepts of the present invention, comprising a lower slide portion 14 and an upper sheave assembly 16, the latter comprising a sheave 18 in the form of a pulley-shaped wheel; a pair of spaced-apart side cheeks 20 and 22 (see FIG. 4) embracing the sheave at opposite ends thereof; and a sheave pin 24 extending normally axially between the two side cheeks, supported by the cheeks, and through the sheave, the sheave being rotatably mounted on the pin.

The slide portion 14 can be of any shape or configuration, and in the scope of the present invention can be broadly any base member attaching the sheave assembly to a ground. In the example of FIG. 1, it is preferably in the form of a slightly elongated body 28 having underturned, opposed flanges 30 and 32 (FIGS. 4 and 5) adapted to engage a conventional track. At one end of the slide, there is provided a downwardly extending movable pin 34 (FIG. 3) adapted to engage a portion or portions of the track to stop the block at selected points longitudinally along the track. The pin 34 is spring loaded, as by spring 36 (FIG. 3), engaging recess 38 in the underside of body 28, loading the pin 34 to its lowermost position. The pin is movable upwardly to disengage from a track by finger gripping a ring 40 attached to the upper end of the pin.

By the present invention, the side cheeks 20 and 22 are pivotally mounted on the slide portion 14 by means of a longitudinally extending pin 42 (FIGS. 3 and 4) adapted to extend between upstanding, spaced-apart shoulders 44 and 46 of the slide positioned near or at opposite ends of the slide. To do this, the side cheeks are configured generally in the shape of a capital ell (L), as shown in FIG. 4, provided with lower, inwardly extending fingers 48, 50 and 52 adapted to encircle and engage the pin 42. One of the fingers 50 is an integral part of side cheek 22 (see FIGS. 2 and 4), and the other two fingers 48 and 52 are integral parts of the other side cheek 20 (see FIG. 1). As clearly shown in FIG. 3, the two fingers 48 and 52 are spaced apart, with the single finger 50 being meshed or seated between the fingers 48 and 52. The walls, e.g., walls 47 and 49 defining the fingers 48 and 52, for example, diverge from the point of attachment 45 to the cheek 20 to accommodate the bore 43 at the free end of the fingers 48 and 52. A similar structure is provided on the cheek 22 for the finger 50.

Figure 5:
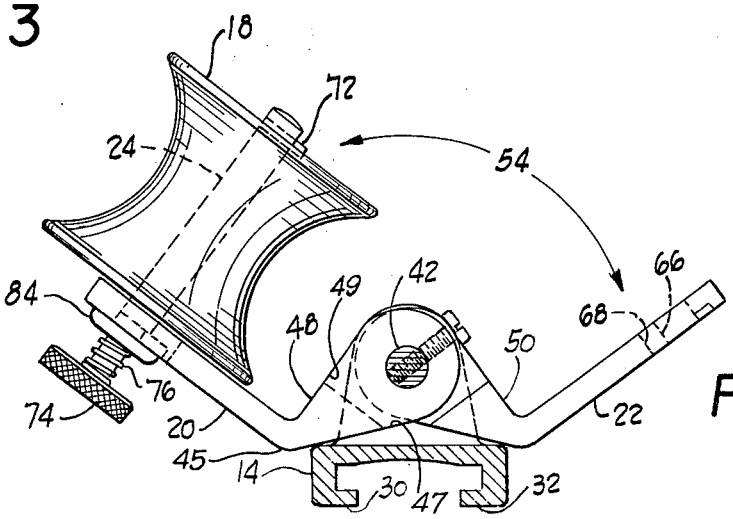
FIG. 5 is an end view of the snatch block of FIG. 1, showing the snatch block in a wide open position.

By the above structure, the two cheeks are pivotable on pin 42 away from each other as shown in FIG. 5 providing a very wide mouth 54 for easy threading, wider than available with prior art structures.

Figure 3:
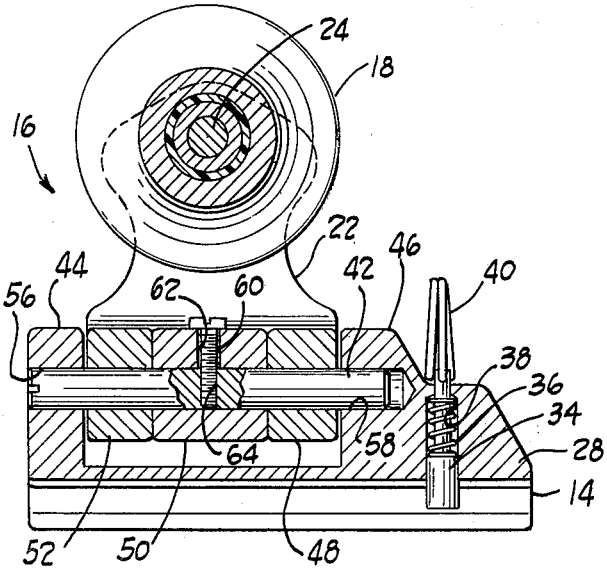
FIG. 3 is a section view of the snatch block of FIG. 1 taken through the center of the block, or along line 3—3 of FIG. 4.
Figure 4:
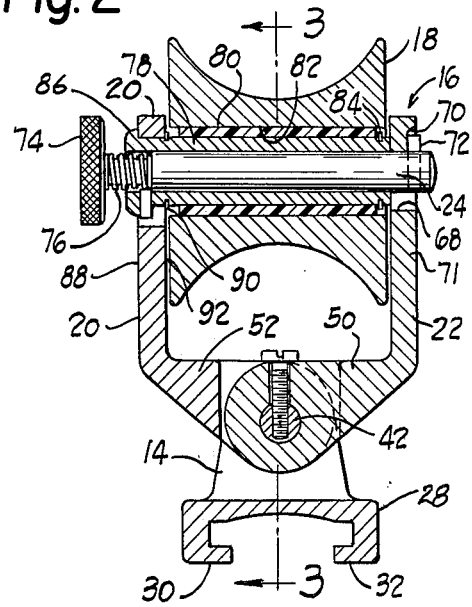
FIG. 4 is a section view of the snatch block of FIG. 1, taken along line 4—4 of FIG. 1.

In the embodiment illustrated in the Figures, assembly of the component parts is achieved by drilling a hole 56 through shoulder 44, as shown in FIG. 3, extending longitudinally in the block assembly, and coaxially therewith, a recess 58 in the opposite shoulder 46, in the side thereof facing shoulder 44. The sheave assembly, with fingers 48, 50 and 52 intermeshed and aligned, is then positioned in the space between shoulders 44 and 46, and the pin 42 is inserted through the hole 56 and through the fingers 48, 50 and 52 into recess 58. When all of the component parts are in position, set screw 60 is inserted into hole 62 in the top of the center finger 50, and is threaded into tapped recess 64 in pin 42 aligned with hole 62. This locates the side cheeks 20 and 22 securely on the pin 42, and holds the entire assembly between the shoulders 44 and 46. Cheek 22 and spaced fingers 48 and 52 are able to rotate freely on the pin 42, cheek 24 and finger 50 rotating with the pin 42.

Figure 2:
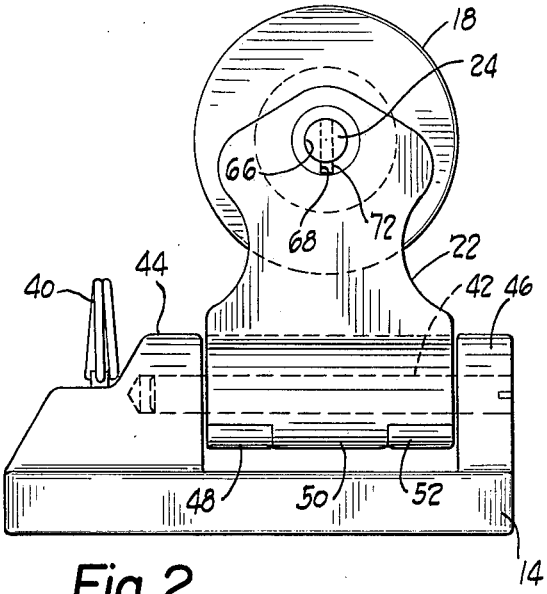
FIG. 2 is an elevation view of the opposite side of the snatch block of FIG. 1.

A preferred method for holding the sheave assembly 16, including sheave 18 and side cheeks 20 and 22, in a closed position comprises providing in cheek 22, which is the cheek pivotable away from cheek 20 (see FIG. 5), an aperture 66 (FIG. 2) through which the sheave pin 24 is adapted to extend when the cheek 22 is moved into a closed position. The aperture 66 has at one point on its periphery a radially extending slot 68, FIGS. 2 and 4, (which extends all the way through the side cheek), and at another point, preferably 180° removed from the radially extending slot 68, a half slot or groove 70, FIG. 4 (which extends only slightly into the outside surface 71 of the cheek 22). Both the slot 68 and half slot or groove 70 are adapted to accommodate a radially extending needle 72 at the free end of sheave pin 24. In FIG. 2, the pin 24 is shown as turned so needle 72 extends downwardly and is adapted to pass through radial slot 68. In FIG. 4, the pin is turned so that needle 72 extends upwardly and seats in half slot 70. In operation, the cheeks are moved together to a closed position, after threading a sheet around the sheave 18, from the open position of FIG. 5, so that the sheave pin extends through aperture 66 oriented to permit needle 72 to slide through slot 68. A knurled knob 74 (FIG. 4) on the opposite end of the sheave pin 24 permits the sheave pin to be turned by an operator for the needle 72 to engage the half slot 70. Spring 76 pressing against the underside of the knob 74 loads the knob in a direction away from cheek 20 to hold the needle 72 in the half slot 70, against inadvertent displacement from the half slot. Only pressure by an operator inwardly against the knurled knob permits it to be turned for disengagement from the half slot and passage through the full slot 68 for opening of the assembly back to the position of FIG. 5.

Assembly of the sheave components is shown in FIG. 4. Around the sheave pin 24 is a cylindrical bearing outer sleeve 78 which slides or rotates within a complementary cylindrical inner bearing sleeve 80. The latter is press-fitted into hole 82 formed axially through the sheave. Retaining ring 84 embedded in sleeve 78 at the outboard or right end (in FIG. 4) prevents the sheave (and sleeve 80) from sliding off the pin 24 to the right. At the opposite or left end, the inner sleeve 80 is provided with an outwardly extending shoulder 86 which bears against the outer surface 88 of side cheek 20. Retaining ring 90 embedded in sleeve 78 bears against the inner surface 92 of side cheek 20 thereby securely holding the sheave, sheave pin and bearing components on the side cheek 20, as shown in FIG. 5.

Although the present invention is not restricted as to materials employed, it is a feature of the present invention that the sheave can be made of a luminescent (fluorescent) material which glows in the dark making easier changes of leads in the dark.

What is claimed is:

1. A snatch block particularly suitable for marine use comprising:

(a) an elongated base body having a longitudinal axis and having on the underside thereof underturned oppositely inwardly directed flanges disposed parallel to said axis and adapted to slidably engage a track, and a pair of axially spaced upstanding shoulders on the upper side thereof;

(b) a longitudinally extending pin carried by and extending between said shoulders;

(c) first and second spaced side cheeks hingedly mounted on said longitudinally extending pin, said cheeks extending upwardly from said base and each having a normally upstanding portion and a laterally extending foot portion defining an L-shape, the free extremity of said foot portion including a bore for rotably mounting said cheeks on said pin, said foot portion having upper and lower diverging walls from the juncture with said upstanding leg portion to accommodate said bore, the lower diverging wall coacting with said base body when said cheek is rotated outwardly to limit its rotation about said pin to hold said cheeks, respectively, in an open, flared position, and each of said cheeks having a bore extending through the upstanding leg portion;

(d) a sheave pin extending between said side cheeks and through said bore through each upstanding leg portion when said cheeks are in the normally closed position, said sheave pin being mounted on said first side cheek for limited axial movement with respect thereto, and having an extremity thereof projecting beyond the outside surface of said second cheek;

(e) means located on said projecting extremity for selectivity manually rotating said sheave pin;

(f) means coacting between the second cheek and said sheave pin for selectively locking and unlocking said second cheek in its normally upright position; and (g) a sheave rotatably mounted on said sheave pin.

2. The snatch block of claim 1 wherein said sheave is luminescent.

3. A snatch block as defined in claim 1 wherein said means for rotating said sheave pin includes a knob integral with said projecting extremity.

4. A snatch block as defined in claim 3 including resilient means carried by said sheave pin and coacting between said knob and said outside surface of said first cheek to bias said sheave pin outwardly.

5. A snatch block as defined in claim 4 wherein said sheave pin includes a radially extending needle projecting from said sheave pin at the opposite extremity thereof, said needle being dimensioned for interferring engagement with the end of said sheave whereby said sheave pin is held in sheave-retaining position against the inner surface of said first cheek.

6. A natch block as defined in claim 5 wherein said second cheek includes a radial slot extending therethrough and communicating with said bore, said radial slot being dimensioned for free passage of said radial needle therethrough, whereby when said sheave pin is moved axially against the bias of said resilient means, and the projecting needle moved through said radial slot to the outside of said second cheek, and the knob rotated, the projecting needle frictionally engages the outside of said second cheek to releasably retain both said cheeks in their normally closed condition with the sheave rotatably mounted therebetween.

* * * * *